United States Patent [19]

White

[11] Patent Number: 4,808,028

[45] Date of Patent: Feb. 28, 1989

[54] BOAT LIFT

[76] Inventor: Charles J. White, Rte. 2, Box 439, Camdenton, Mo. 65020

[21] Appl. No.: 148,076

[22] Filed: Jan. 25, 1988

[51] Int. Cl.[4] ..... B63C 1/00

[52] U.S. Cl. ..... 405/3; 114/45; 405/7

[58] Field of Search ..... 405/1, 3, 4, 7; 114/44, 114/45

[56] References Cited

U.S. PATENT DOCUMENTS

| | | | |
|---|---|---|---|
| 3,841,441 | 10/1974 | Klinkhammer et al. | 405/3 X |
| 3,857,248 | 12/1974 | Rutter | 405/3 |
| 4,381,723 | 5/1983 | Furst | 114/45 |
| 4,391,550 | 7/1983 | Rutter | 405/7 |

*Primary Examiner*—David H. Corbin

*Attorney, Agent, or Firm*—Senniger, Powers, Leavitt and Roedel

[57] ABSTRACT

A boat lift for installation in a boat well in a boat dock between the opposing sides of the boat well to lift a boat out of the water and lower a boat into the water. The boat lift comprises a frame adapted to receive and support a boat, at least one pontoon mounted on the frame and adapted to be flooed and evacuated to lower and raise the frame, and a pair of forward and rearward supports on the frame. Each of the supports is supported between a pair of rollers on a mounting bracket on the side of the boatwell, the brackets supporting the supports so that the frame is sloped with the back of the frame being elevationally above the front of the frame.

7 Claims, 5 Drawing Sheets

BOAT LIFT

BACKGROUND OF THE INVENTION

This invention relates to boat lifts, and in particular to an improved boat lift of the type adapted to be mounted in the boat well of a dock to lift a boat out of the water for storage and to lower the boat for use.

It is desirable to store a boat out of the water when it is not in use to minimize problems of corrosion, marine growth, and leakage. A variety of boat lift devices have be designed to provide a means for storing a boat out of the water, while allowing to the boat to be relaunched when needed. Examples of such devices are shown in U.S. Pat. Nos. 4,072,119, 4,018,179, 3,895,592, 3,857,248, 3,083,540, 3,177,668, 3,265,024, 3,169,644, 3,727,415, 3,603,276, 3,448,712, 3,362,172. These boats lifts are used in a harsh, corrosive environment, and they are subject to frequent breakdowns. Corrosion and weather damage often impairs or impedes the operation of these devices.

SUMMARY OF THE INVENTION

It is among the objects of the present invention to provide a boat lift that is of simple, inexpensive construction that operates reliably and has a long service life; in particular it is among the objects of the present invention to provide such a boat lift that is less prone to binding, jamming, or failure in operation. It is also among the objects of the present invention to provide such a boat lift that is easy to install and adjust for proper operation.

The boat lift of the present invention is adapted to be mounted in a boat well of a boat dock which has parallel sidewalls spaced sufficiently apart for a boat to fit therebetween. Generally the boat lift of the present invention comprises a frame having a front, a back, and left and right sides, sized to fit in the boat well between the opposing sides, the frame adapted to be lowered to receive a boat floating in the water and to be raised with the boat thereon to lift the boat out of the water. At least one pontoon is mounted on the frame, the pontoon being adapted to be filled with water to lower the frame and to be filled with air to lift the frame. There is a pair of sloped forward supports, one on the left and right sides of the frame, generally adjacent the front. There is also a pair of sloped rearward supports, one on the left and right sides of the frame, generally adjacent the back of the frame. The forward and rearward supports are substantially parallel.

The boat lift further comprises a pair of forward mounting brackets adapted to be mounted on the opposing sidewalls of the boat well, generally adjacent the front of the frame, and a pair of rearward mounting brackets adapted to be mounted on the opposing sidewalls of the boat well, generally adjacent the back of the frame, each of the brackets comprising a pair of longitudinally spaced rollers adapted to receive one of the supports therebetween and guide the supports as the frame is raised and lowered, the rollers on the brackets supporting the supports so that the frame is sloped with the back of the frame being elevationally above the front of the frame.

In the preferred embodiment, the frame is sloped at an angle of about 2° with respect to horizontal. Preferably, at least one of the rollers on each bracket is adjustable to support the frame in the desired sloped configuration. This adjustability may be accomplished by employing a roller supported by an axle that is eccentrically secured to the bracket, thereby allowing the position of the axle to be adjusted to adjust the position of the roller.

In the preferred embodiment, the supports slope generally forwardly with respect to the frame, forming an angle of between about 35° and 55° with respect to the frame, and preferably about 44° with respect to the frame. However, angles as great as 90° would work.

The device is thus of simple and inexpensive construction, yet is sturdy and reliable, with the rollers reliably supporting and guiding the supports as the frame is raised and lower by the filling and emptying the pontoon. The inventor has discovered that by providing the slight slope of the frame by elevating the back of the frame (which supports the heavier, back end of the boat) with respect to the front, the boat lift of this invention is better able to lift the boat without binding or jamming. These and other advantages will be in part apparent and in part pointed out hereinafter.

BRIEF DESCRIPTION OF THE DRAWINGS

Corresponding reference numerals indicate corresponding parts throughout the several views of the drawings.

DETAILED DESCRIPTION OF THE PREFERRED EMBODIMENT

Figure 1:
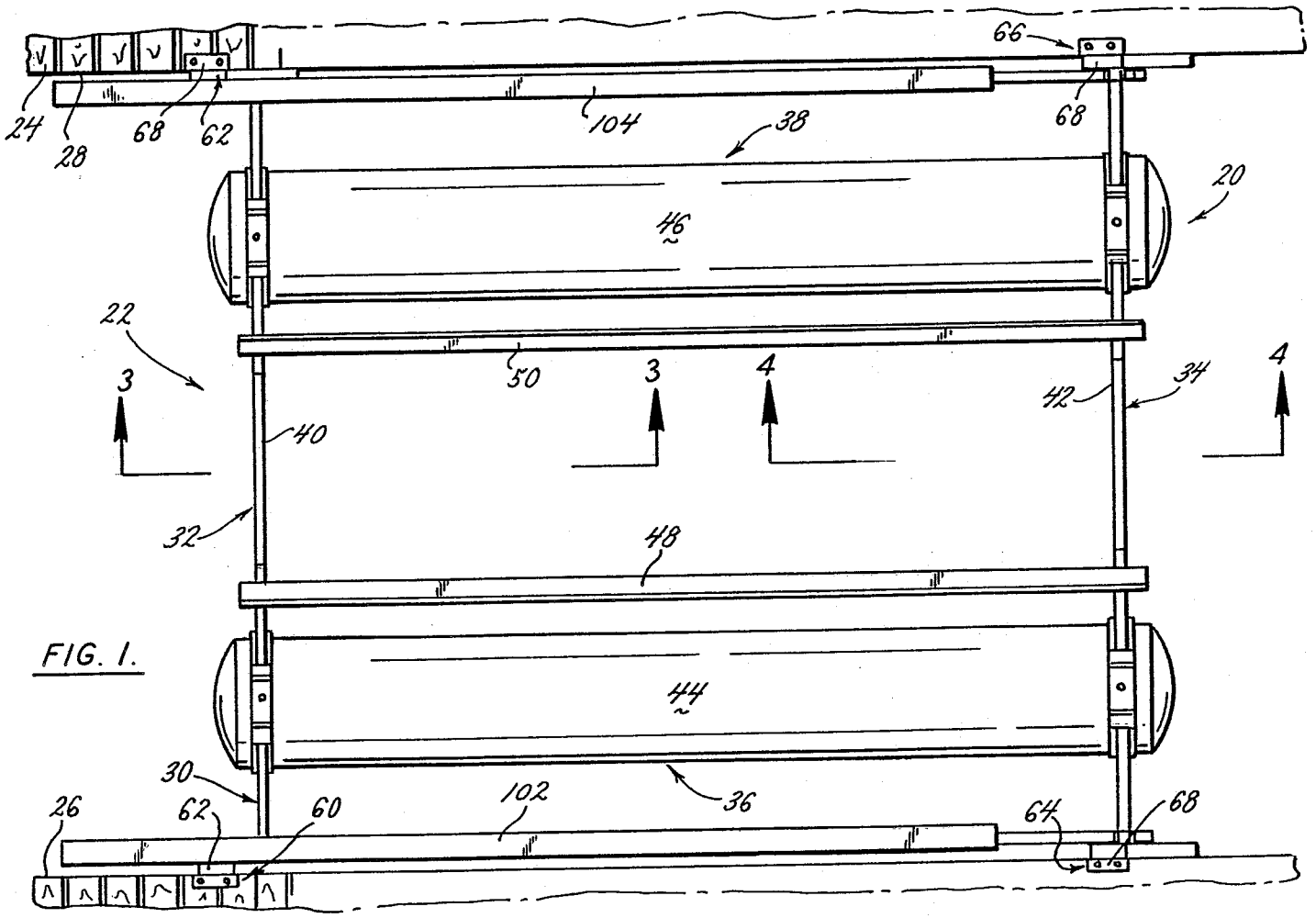
FIG. 1 is a top plan view of a boat lift constructed according to the principles of this invention.
Figure 2:
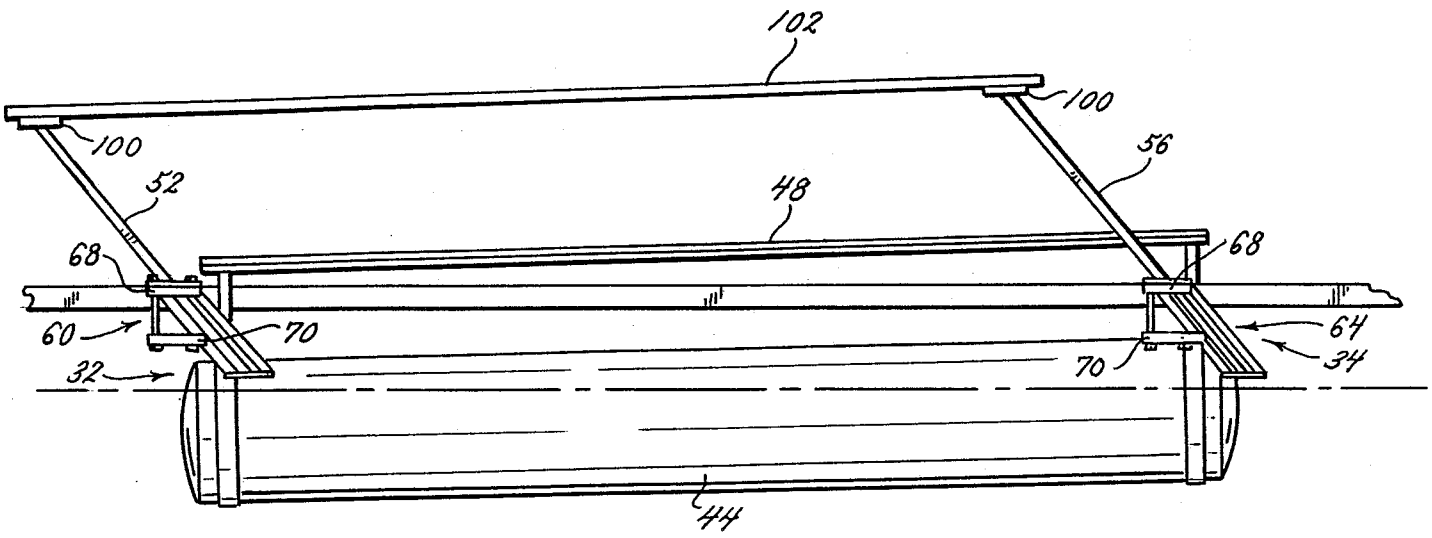
FIG. 2 is a left side elevational view of the boat lift.
Figure 3:
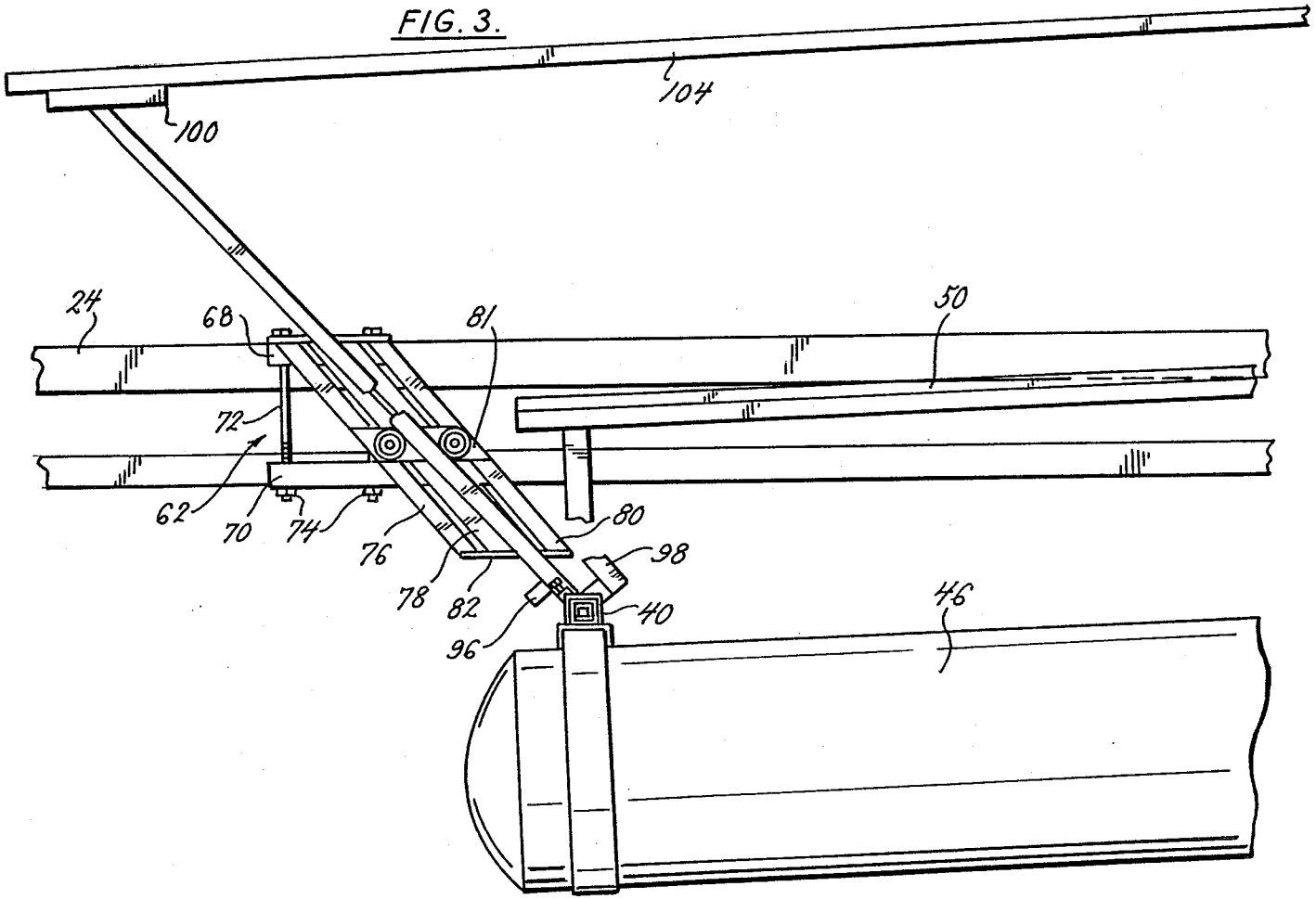
FIG. 3 is a enlarged partial cross-sectional view of the boat lift, taken along the plane of line 3—3 in FIG. 1, showing the right front mounting bracket and support.
Figure 4:
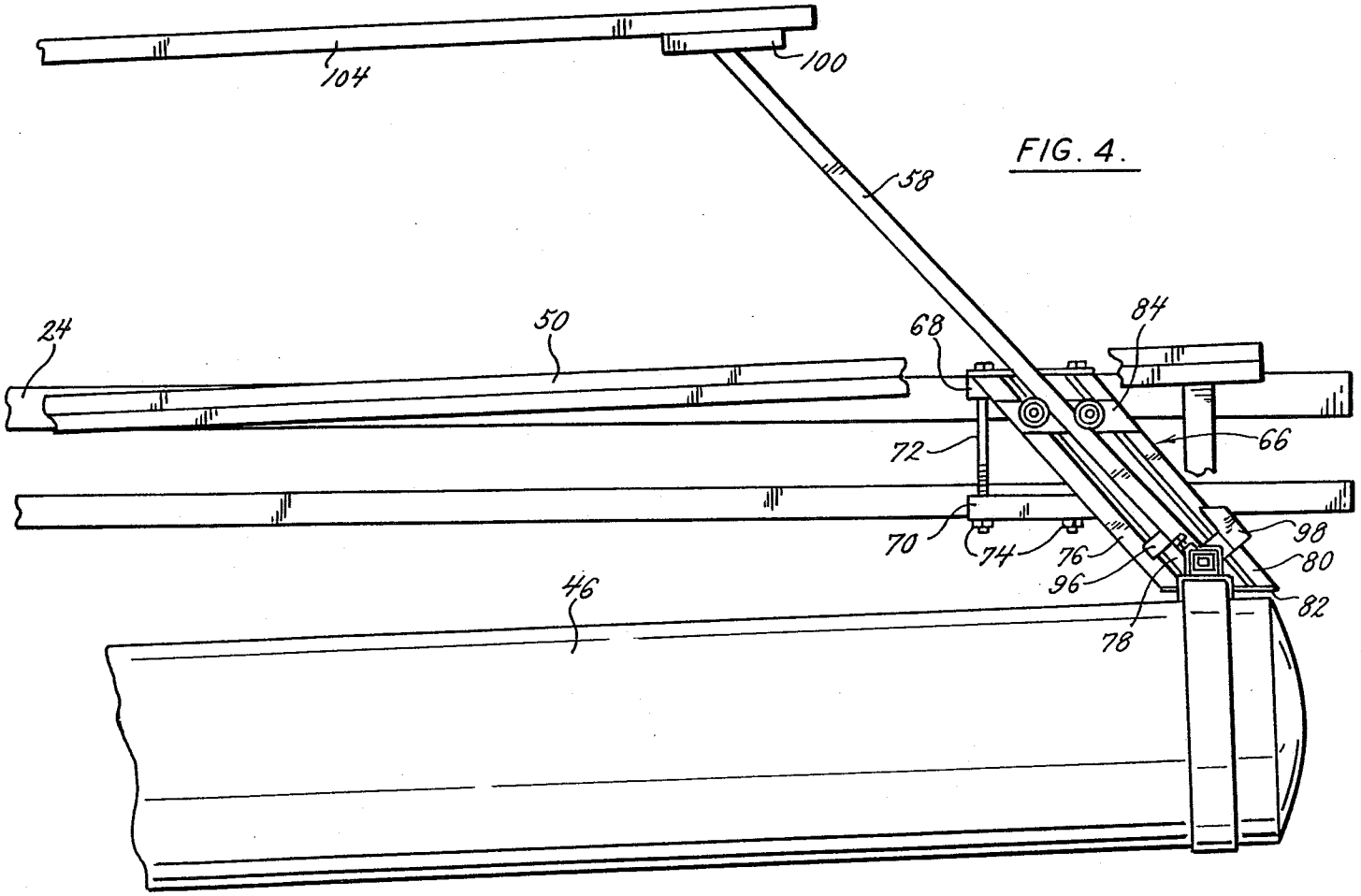
FIG. 4 is an enlarged partial cross-sectional view of the boat lift taken along the plane of line 4—4 in FIG. 1, showing the right rear mounting bracket and support.

A boat lift constructed according to the principles of this invention, indicated generally as 20 in FIG. 1, is shown as it would be mounted in a boat well 22 in a boat dock 24, between left and right parallel opposing sidewalls 26 and 28, respectively. The sidewalls 26 and 28 are spaced sufficiently so that well 22 can accommodate, for example a typical water ski or fishing boat. However, the boat lift of the present invention is not so limited and the inventor intends that it may be used with any suitable watercraft.

The boat lift 20 comprises a frame 30 having a front 32, a back 34, and left and right sides 36 and 38, respectively. In this preferred embodiment, the frame 30 comprises front and back transverse members 40 and 42, which may be made of square steel tube. These transverse members 40 and 42 can comprise a smaller tube telescoping within a larger tube to permit adjustment of the width of the frame. The frame further comprises two pontoons 44 and 46 extending longitudinally between the transverse members 40 and 42, on the left and right sides, respectively. The pontoons 44 and 46 may be secured to the transverse members with hoop-shaped brackets, or other means as is known in the art. The frame 30 is sized to fit in the boat well 22 between the opposing sidewalls 26 and 28.

The frame 30 is adapted to be lowered under the water to receive a boat floated over the top of the submerged frame, and the frame is further adapted to be raised, with the boat thereon, to lift the boat out of the water. The pontoons 44 and 46 are adapted to be filled with water to lower the frame 30 and to be filled with air to raise the frame 30. There are several well-known means for flooding the pontoons and evacuating the pontoons, which are known to persons of ordinary skill in the art. For example the pontoons can be flooded by opening an air valve in the top of the pontoon to allow the air in the pontoons to be displaced by water to fill the pontoon with water and thereby lower the frame. An air pump can be used to pump air into the water filled pontoons to fill the pontoon with air and thereby raise the frame.

Left and right runners 48 and 50, respectively, extend between the front and back transverse members 40 and 42, and are positioned to engage and support the bottom of the boat. Runners 48 and 50 may be covered with carpeting or some other material to cushion and protect the bottom of the boat. Additional boat supports may be provided as is known to persons of ordinary skill in the art.

A pair of sloped forward supports 52 and 54, extend upwardly from the left and right sides, respectively, of frame 30, generally adjacent the front. In the preferred embodiment, the lower ends of the supports 52 and 54 are attached to the front transverse member 40. A pair of sloped rearward supports 56 and 58 extend upwardly from the left and right sides, respectively, of frame 30, generally adjacent the back. In the preferred embodiment, the lower ends of the supports 56 and 58 are attached to the rear transverse member 42. The supports may be made of square steel tube. The front and rear supports 52, 54 and 56, 58 preferably slope forwardly at an angle of between about 35° and 55° with respect to the frame 30, and preferably about 44° with respect to the frame 30. However, angles as great as 90° would work. The forward supports 52, 54 and the rearward supports 56 and 58 are substantially parallel to each other.

Figure 5:
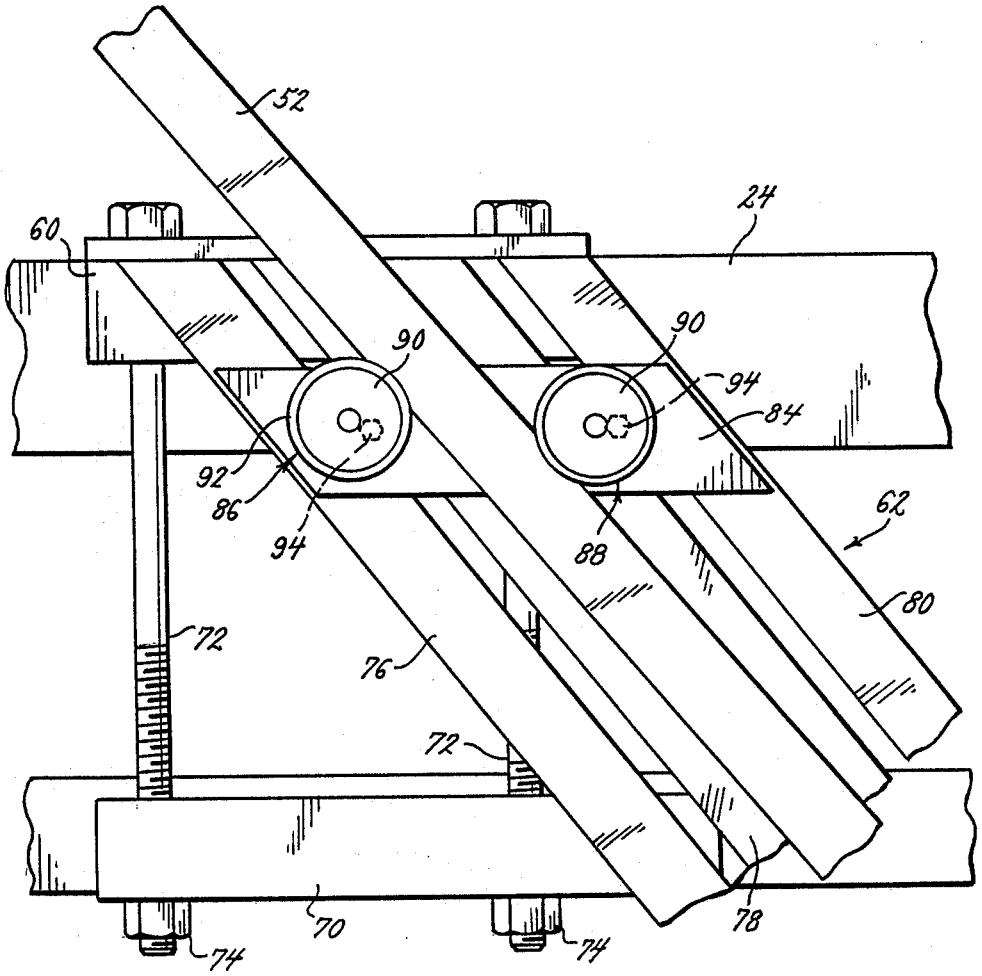
FIG. 5 is an enlarged side elevation view of the right front mounting bracket, showing the rollers.

The boat lift 20 further comprises a pair of forward mounting brackets 60 and 62, respectively, adapted to be mounted on the opposing sidewalls 26 and 28 of the boat well 22, in a position generally adjacent the front 32 of the frame 30. There is also a pair of rearward mounting brackets 64 and 66 adapted to be mounted on the opposing sidewalls 26 and 28 of the boat well 22, generally adjacent the back 34 of the frame 30. FIG. 5 is a side elevation view of right front bracket 62, and illustrates the construction of all the brackets, right rear bracket 66 being identical to bracket 62 and left front and rear brackets 60 and 64 being mirror images of bracket 62. Each of the brackets comprises top and bottom jaw members 68 and 70, adapted to engage the top and bottom of the deck members forming the sidewalls 26 and 28 of the boat well 22. Bolts 72 and nuts 74 secure the top and bottom jaw members 68 and 70 to their respective deck members. Three strips 76, 78, and 80 slope downwardly and rearwardly from the top jaw member 68. The lower end of the strips may be stabilized by a cross member 82, if desired.

A parallelogram-shaped mounting plate 84 in mounted over the strips 76, 78, and 80, intermediate their ends. A pair of longitudinally spaced rollers 86 and 88 are mounted on plate 84, the rollers adapted to receive and support one of the support members between them. Preferably at least one of the rollers 86 and 88 on each of the brackets is adjustable. In the preferred embodiment, each of the rollers comprises an axle member 90 which supports a annular roller member 92. Each axle member 90 is eccentrically secured to the plate 84 by bolt 94 so that the axle member 90 can be turned to change the position of the roller member 92. The bolts 94 secure the axle members 90 to plate 84 between the strips 76, 78, and 80.

Bracket 60 supports support 42; bracket 62 supports support 54; bracket 64 supports support 56; and bracket 66 supports support 58, each of the brackets supporting its respective support between its rollers 86 and 88. The rollers 86 and 88 guide the supports as the frame 30 is raised and lowered. The rollers on the brackets also support the supports so that the frame 30 is sloped with the back 34 of the frame 30 being elevationally above the front 32 of the frame 30. In the preferred embodiment, the frame is sloped at an angle of about 2° with respect to horizontal. The inventor has discovered that by constructing the boat lift 20 with the frame 30 sloped so that the back 34 is higher than the front 32, the lift operates more smoothly, with less chance for binding and jamming. The inventor believes that this due, at lest in part, to the fact that the back 34 of the frame 30 bears a greater load since the back of the boat is heavier that the front 32. The adjustable rollers allow sufficient adjustment to achieve the desired sloped configuration.

The bottom ends of the supports 52, 54, 56, and 58 each has a stop 96 on their forward side to engage the forward-most roller 86 and limit the upward travel of the frame 30 relative to the brackets. The bottom ends of the supports preferably also have a hook-shaped catch 98 on their rearward side to engage the rearward-most roller 88, also to limit the upward travel of the frame 30 relative to the brackets. The top ends of the supports preferably have a horizontal cap 100 to engage the rollers 86 and 88 and limit the downward travel of the frame 30. Left and right side bars 102 and 104 can be mounted between the horizontal caps 100 on each side of the supports to provide a convenient step for entering and exiting a boat mounted on the frame. The side bars may be carpeted or otherwise covered to improve the comfort and traction for those stepping on it.

OPERATION

The boat lift 20 of the present invention is installed by floating the frame member 30 into the boat well 22. The brackets 60, 62, 64 and 66 are then positioned on the sidewalls 26 and 28 of the boat well 22, with the rollers of each bracket around the bracket's respective support member. The brackets are secured in their proper positions by tightening nuts 74 on bolts 72 to clamp the top and bottom jaw members 68 and 70 around the dock members forming the sidewalls 26 and 28 of the boat well 22. The rollers of the rearward brackets 64 and 68 are adjusted to engage and support the rearward support members 56 and 58, by turning axle member 90 until roller members 92 firmly support the support members, and securing axle members 90 by tightening bolts 94. Then, the front 32 of the floating frame member 30 is held down, for example with a weight, so that the frame 30 has the desired downward slope of about 2°. Over a typical 18–20 foot length, the front 32 would be about 6–8 inches lower than the back 34. The rollers on the front brackets 60 and 62 are then adjusted to engage and support the forward support members 52 and 54, by turning the axles 90 until roller members 92 firmly support the support the support members, and maintain the desired slope of the frame. The axle members 90 are then secured by tightening bolts 94.

Once installed the boat lift 20 is easily used by flooding pontoons 44 and 46 so that the frame 30 submerges. The caps 100 prevent the frame from sinking completely, and keep the supports in engagement with the rollers on the brackets. A boat may then be floated into the boat well, over the submerged frame 30. The pontoons 44 and 46 may then be filled with air to raise the frame 30 and lift the boat from the water. As the frame 30 rises, the frame generally maintains its forward slope, raising the heavier back end of the boat before the lighter front end of the boat, and eliminating much of the binding and jamming experienced with prior boat lifts. The slope causes more of the air to accumulate in the higher, rearward portions of the pontoons 44 and 46, thereby providing more bouyant force for the back of the boat. The stop 96 and the catch 98 prevent the frame 30 from rising too high, and keep the supports in engagement with the rollers. The boat can be easily lower for use by flooding the pontoons 44 and 46.

The device is thus of simple and inexpensive construction, yet is sturdy and reliable, with the rollers reliably supporting and guiding the supports as the frame 30 is raised and lower by filling and emptying the pontoons 44 and 40. The inventor has discovered that by providing the slight slope of the frame 30, elevating the back of the frame (which supports the heavier, back end of the boat) with respect to the front, the boat lift of this invention is better able to lift the boat without binding or jamming.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

I claim:

1. A boat lift for installation in a boat well in a boat dock between the opposing sides of the boat well to lift a boat out of the water and lower a boat into the water, the boat lift comprising:

a frame adapted to receive and support a boat, the frame having a front, a back and left and right sides;

at least one pontoon, mounted on the frame, the pontoon adapted to be filled with air to lift the frame and to be filled with water to lower the frame;

a pair of sloped forward supports, on the left and right sides of the frame generally adjacent the front of the frame;

a pair of sloped rearward supports, on the left and right sides of the frame generally adjacent the rear of the frame the forward and rearward supports being parallel;

a pair of forward mounting brackets adapted to be mounted on opposite sides of the boat well, generally adjacent the front of the frame, and a pair of rearward mounting brackets adapted to be mounted on opposite sides of the boat well, generally adjacent the rear of the frame, each of the mounting brackets having a pair of spaced apart rollers thereon adapted to receive one of the supports therebetween, the brackets supporting the supports so that the frame is sloped with the back of the frame being above the front of the frame.

2. The boat lift according to claim 1 wherein the frame is sloped at an angle of about 2° with respect to horizontal.

3. The boat lift according to claim 1 wherein the center of rotation of at least one of the rollers on each bracket is adjustable, to adjust the spacing and position of the roller.

4. The boat lift according to claim 3 wherein at least one roller on each bracket comprises an eccentrically mounted axle member and a roller member mounted on the axle member, so that adjustment of the position of the axle member adjusts the position of the roller member.

5. The boat lift according to claim 1 wherein the front and rearward supports slope generally forwardly with respect to the frame.

6. The boat lift according to claim 5 wherein the front and rearward supports form an angle of between about 35° and about 55° with respect to the frame.

7. The boat lift according to claim 6 wherein the front and rearward supports form an angle of about 44° with respect to the frame.

* * * * *